US009972937B2

(12) United States Patent
Akagi et al.

(10) Patent No.: US 9,972,937 B2
(45) Date of Patent: May 15, 2018

(54) LEVER TYPE CONNECTOR

(71) Applicant: YAZAKI CORPORATION, Tokyo (JP)

(72) Inventors: Yosuke Akagi, Shizuoka (JP); Kaoru Sawairi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 15/709,013

(22) Filed: Sep. 19, 2017

(65) Prior Publication Data

US 2018/0083385 A1 Mar. 22, 2018

(30) Foreign Application Priority Data

Sep. 21, 2016 (JP) ..... 2016-183833

(51) Int. Cl.
*H01R 13/62* (2006.01)
*H01R 13/629* (2006.01)
*H01R 13/516* (2006.01)

(52) U.S. Cl.
CPC ..... *H01R 13/62938* (2013.01); *H01R 13/516* (2013.01)

(58) Field of Classification Search
CPC ..... H01R 13/516; H01R 13/62938
USPC ..... 439/157, 140, 141, 372
See application file for complete search history.

(56) References Cited

U.S. PATENT DOCUMENTS 6,142,787 A * 11/2000 Ikesugi ..... H01R 13/62933 439/15
6,213,792 B1 * 4/2001 Tsuji ..... H01R 13/62911 439/152
6,305,957 B1 * 10/2001 Fink ..... H01R 13/62977 439/157
6,341,968 B1 * 1/2002 Grant ..... H01R 13/62938 439/157
6,422,881 B1 * 7/2002 Puhl ..... H01R 13/4538 439/140
7,267,562 B2 * 9/2007 Katsuma ..... H01R 13/516 439/140
7,445,474 B2 * 11/2008 Sakatani ..... H01R 13/62938 439/157
7,559,779 B1 * 7/2009 Caines ..... H01R 13/62938 439/157

(Continued)

FOREIGN PATENT DOCUMENTS

JP 2011-142050 A 7/2011

*Primary Examiner* — Abdullah Riyami
*Assistant Examiner* — Nelson R Burgos-Guntin
(74) *Attorney, Agent, or Firm* — Metrolexis Law Group, PLLC

(57) ABSTRACT

A lever type connector includes a male housing having a hood part, a lever rotatably supported on the male housing, a moving plate for positioning a tab part of a male terminal within the hood part and a female housing to be fitted into and detached from the hood part. By operating the lever forward, it is possible to allow the female housing to move to an inner side of the hood part together with the moving plate, thereby allowing the female housing to be fitted into the male housing. When the male housing is not fitted to the female housing, a rib of the lever abuts against a boss of the moving plate. When the abutment between the rib and the boss is released by operating the lever forward, the female housing is permitted to push the moving plate into the hood part.

4 Claims, 20 Drawing Sheets

(56) References Cited

U.S. PATENT DOCUMENTS

| | | | | |
|---|---|---|---|---|
| 8,147,261 | B2 * | 4/2012 | Horiuchi | H01R 13/514<br>439/157 |
| 8,926,344 | B2 * | 1/2015 | Jozwiak | B60R 16/0238<br>439/140 |
| 2005/0064749 | A1 * | 3/2005 | Stella | H01R 13/453<br>439/157 |
| 2006/0240693 | A1 * | 10/2006 | Nishide | H01R 13/62938<br>439/157 |
| 2006/0281351 | A1 * | 12/2006 | Yamaoka | H01R 13/62938<br>439/157 |
| 2006/0286834 | A1 * | 12/2006 | Fukatsu | H01R 13/62938<br>439/157 |
| 2006/0292907 | A1 * | 12/2006 | Nishide | H01R 13/447<br>439/157 |
| 2009/0181566 | A1 * | 7/2009 | Shibata | H01R 13/62938<br>439/157 |
| 2009/0311893 | A1 * | 12/2009 | Sugiyama | H01R 13/62938<br>439/157 |
| 2014/0127921 | A1 * | 5/2014 | Shimizu | H01R 13/64<br>439/157 |
| 2014/0134861 | A1 * | 5/2014 | Noda | H01R 13/62938<br>439/157 |
| 2014/0235081 | A1 * | 8/2014 | Shimizu | H01R 13/62933<br>439/157 |
| 2014/0242822 | A1 * | 8/2014 | Suzuki | H01R 13/56<br>439/157 |
| 2015/0004829 | A1 * | 1/2015 | Aoki | H01R 13/629<br>439/372 |
| 2016/0141799 | A1 * | 5/2016 | Kataoka | H01R 13/62938<br>439/372 |

* cited by examiner

LEVER TYPE CONNECTOR

CROSS REFERENCE TO RELATED APPLICATION

The present application is based on, and claims priority from Japanese Patent Application No. 2016-183833, filed Sep. 21, 2016, the disclosure of which is hereby incorporated by reference herein in its entirety.

TECHNICAL FIELD

The present application relates to a lever type connector in which male and female housings are fitted to and detached from each other with a low insertion force by operating a lever forward and backward.

BACKGROUND ART

As this kind of a lever type connector in the conventional example, there is a connector disclosed in JP 2011-142050 A.

As illustrated in FIG. 22, the conventional lever type connector 1 includes a male housing 2 having a hood part 3, a lever 5 rotatably supported on the male housing 2 through pivot shafts 4, a moving plate 7 for positioning a tab part of a male terminal (not illustrated) inside the hood part 3, and a female housing 8 to be fitted into and detached from the hood part 3.

The lever 5 is formed with cam grooves 6. The female housing 8 is formed with first cam pins 9*a*, while the moving plate 7 is formed with second cam pins 9*b*. When the lever 5 is displaced with respect to the male housing 2 under a condition that the first cam pins 9*a* and the second cam pins 9*b* are united to each other, the first cam pins 9*a* and the second cam pins 9*b* under the united condition slide on groove surfaces of the cam grooves 6, so that the male housing 2 and the female housing 8 are fitted to and detached from each other. In the fitting process of the male housing 2 and the female housing 8, only the first cam pins 9*a* slide on forward-side cam surfaces 6*a* of the cam grooves 6, so that the moving plate 7 and the female housing 8 move to the inner side of the hood part 3. In the detaching process of the male housing 2 and the female housing 8, only the second cam pins 9*b* slide on backward-side cam faces 6*b* of the cam grooves 6, so that the moving plate 7 and the female housing 8 move to the opening side of the hood part 3.

SUMMARY

In the conventional lever type connector 1, the moving of the moving plate 7 is enabled by assembling the second cam pins 9 b of the moving plate 7 to the cam grooves 6 of the lever 5 for engagement. Therefore, if it occurs necessity of replacing the lever 5 due to its breakage or the like, then an operation of inserting the second cam pins 9*b* of the moving plate 7 into the cam grooves 6 of the lever 5 is required. Then, since there is a possibility that the second cam pins 9*b* of the moving plate 7 cannot be fitted to the cam grooves 6 of the lever 5, in particular, depending on the position of the moving plate 7 in the hood part 3, the assembling workability of the lever 7 has not been good in the connector 1. Nevertheless, if the lever 5 is assembled forcibly, the second cam pins 9*b* of the moving plate 7 may be damaged or broken by the lever 5.

It is therefore an object of the present application to provide a lever type connector capable of improving assembling workability of a lever by eliminating restrictions on the positional relationship between the lever and a moving plate when replacing the lever.

A lever type connector according to an aspect of the present application includes a male housing having a hood part, a lever rotatably supported on the male housing via pivot shafts, a moving plate for positioning a tab part of a male terminal within the hood part, a female housing configured to be fitted into and detached from the hood part, a cam groove formed in the lever, a cam follower formed in the female housing, a rib provided in the lever and a boss formed in the moving plate. The lever type connector is configured so that the female housing is moved to an inner side of the hood part together with the moving plate by forward-operating the lever in a direction capable to fit the male housing and the female housing under a condition that the cam follower is engaged with the cam groove, whereby the female housing is to be fitted into the male housing. The rib abuts against the boss when the male housing is not fitted to the female housing under the condition that the cam follower is engaged with the cam groove, and abutting between the rib and the boss is released by forward-operating the lever in the direction capable to fit the male housing and the female housing, whereby the female housing is permitted to push the moving plate into the hood part.

With the constitution mentioned above, it is possible to prevent the rib from pushing the moving plate when the lever is locked temporarily. Additionally, as the constraints in the positional relationship between the lever and the moving plate in case of replacing the lever are eliminated, it is possible to perform the assembling operation of the lever easily and in a shirt time.

The lever type connector may be configured so that, when the female housing is to be detached from the male housing, the rib abuts against the boss by backward-operating the lever in a direction capable to detach the male housing from the female housing then the moving plate is returned to an original position outside the hood part.

With the constitution mentioned above, when the female housing is to be detached from the male housing, it is possible to return the moving plate to the original position outside the hood part easily and reliably since the rib of the lever pulls up the boss of the moving plate in a drawing manner.

The rib may be formed in a curved shape so as to enable a part of the boss to be surrounded.

With the formation mentioned above, when pulling up the moving plate to return it to the original position, it is possible to prevent the boss from being detached from the rib.

Either one of the male housing and the lever may be formed with an elastic locking piece provided with an locking protrusion and a releasing protrusion, provided that the other of the male housing and the lever is formed with an locking hole which can lock the locking protrusion.

With the constitution mentioned above, since the locking state between the locking protrusion and the locking hole is released by pushing the releasing protrusion when releasing the locking between the male housing and the lever, the operation of releasing the locking between the male housing and the lever can be performed with ease.

DESCRIPTION OF EMBODIMENTS

Lever type connectors according to embodiments will be described with reference to the drawings.

First Embodiment

A lever type connector 10 according to a first embodiment will be described with reference to FIGS. 1 to 17.

Figure 1:
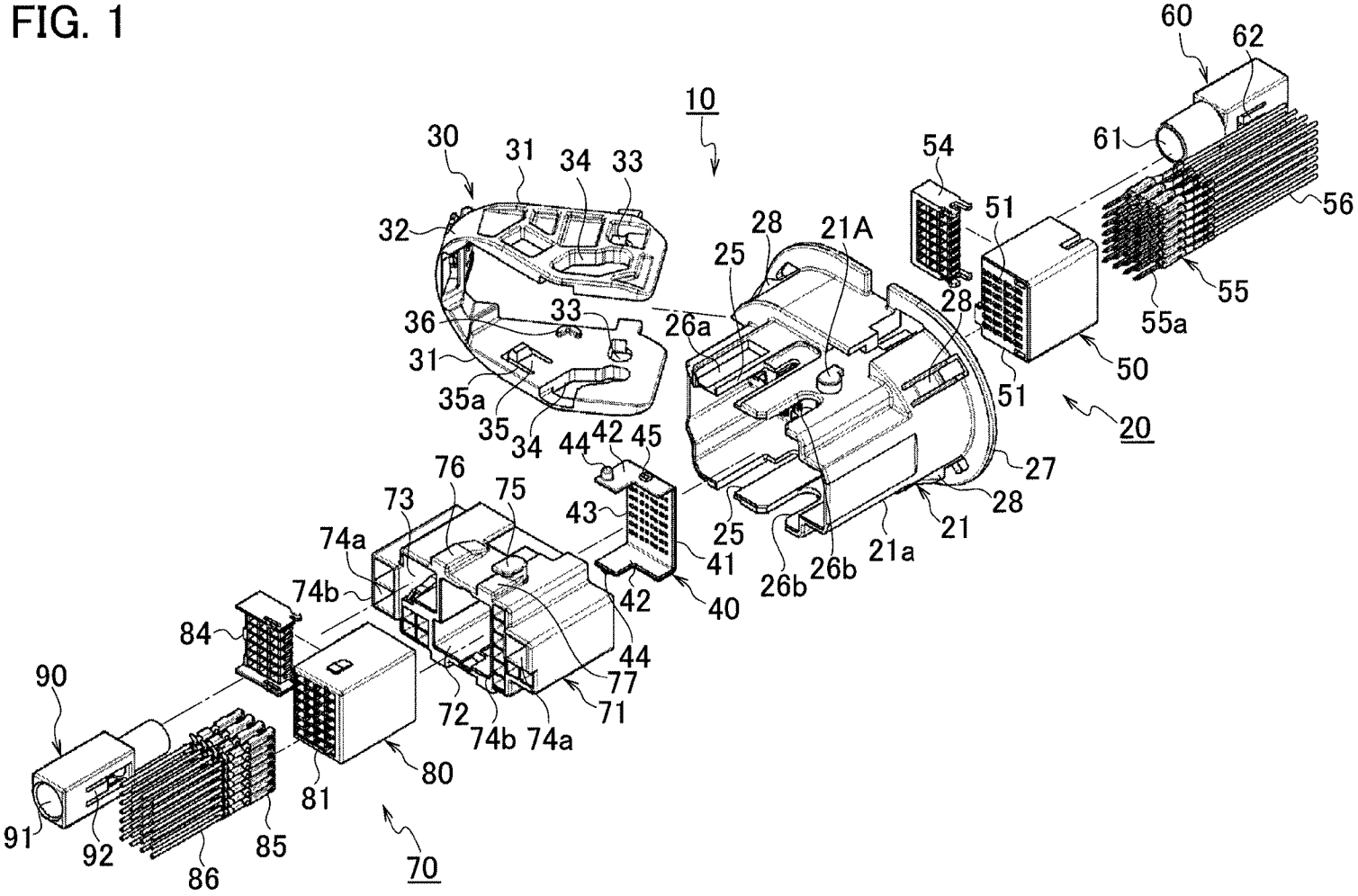
FIG. 1 is an exploded perspective view of a lever type connector according to a first embodiment.
Figure 2:
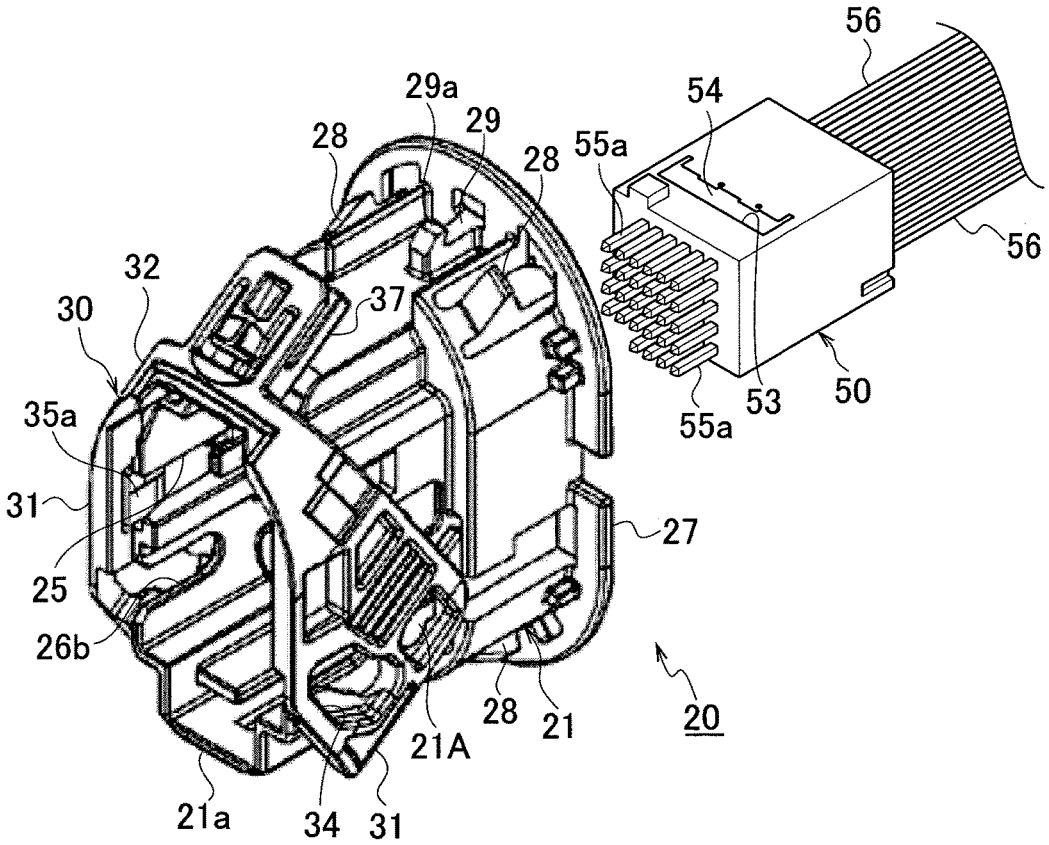
FIG. 2 is a perspective view of a male connector of the lever type connector according to the first embodiment, illustrating a state before assembling.

As illustrated in FIG. 1, the lever-type connector 10 according to the first embodiment includes a male connector 20 and a female connector 70 which are fittable to and detachable from each other. The lever type connector 10 is utilized, for example, as a connector for a front door of a vehicle.

The male connector 20 includes a male housing 21 having a hood part 21*a*, a lever 30 rotatably supported on the male housing 21 via pivot shafts 21A, a moving plate 40 for positioning tab parts 55*a* of male terminals 55 within the hood part 21*a*, a male sub-housing 50 housed in a sub-housing accommodating chamber 22 formed in the male housing 21, and a male coaxial sub-housing 60 housed in a sub-housing insertion hole (not illustrated) formed in the male housing 21.

The female connector 70 includes a female housing 71 having cam followers 75 formed so as to project from the female housing 71 integrally and to be engaged with cam grooves 34 formed in the lever 30, the female housing 71 to be fitted into and detached from the hood part 21*a*, a female sub-housing 80 accommodated in a sub-housing accommodating chamber 72 formed in the female housing 71, and a female coaxial sub-housing 90 accommodated in a sub-housing insertion hole 73 formed in the female housing 71.

Figure 11:
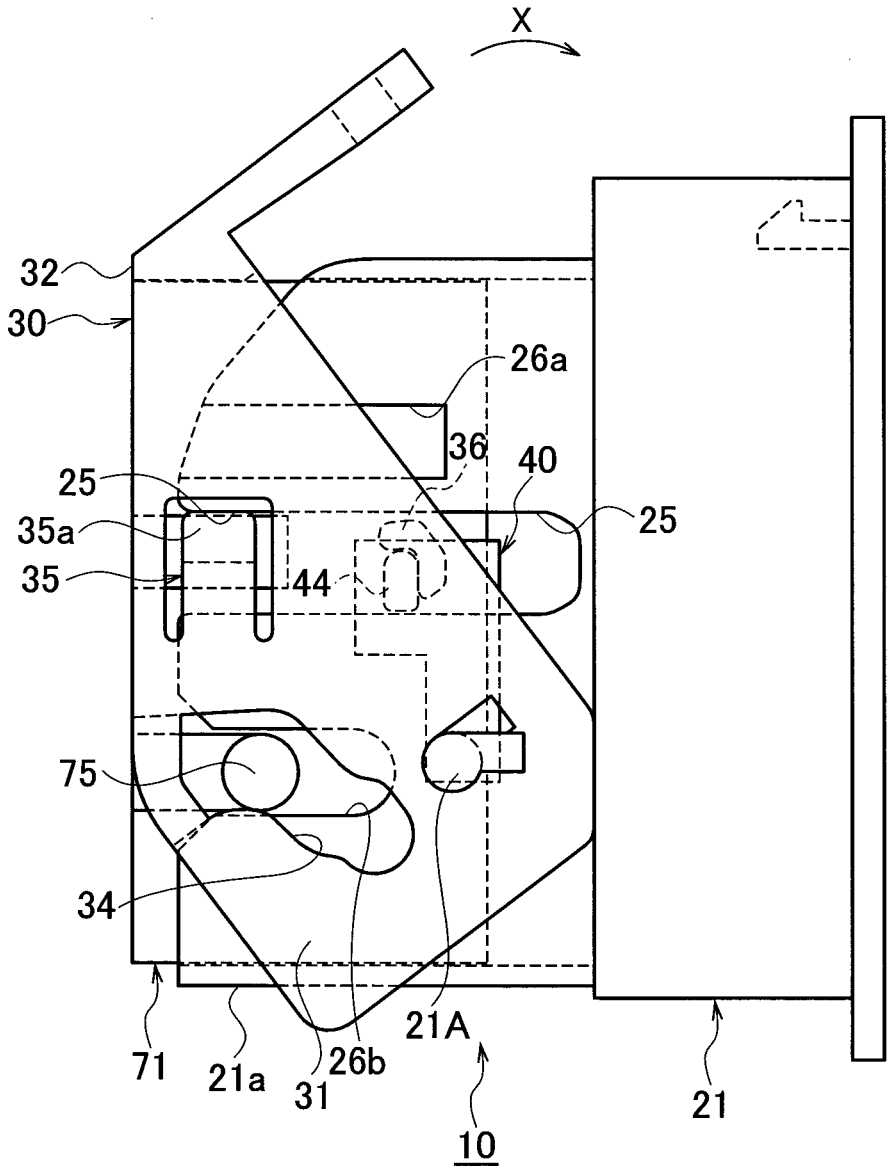
FIG. 11 is a side view at the beginning of the forward operation of the lever of the lever type connector according to the first embodiment.

As illustrated in FIG. 11, when the lever 30 is operated so as to move forward (illustrated with an arrow X in FIG. 11) under a condition that the cam followers 75 of the female housing 71 are engaged with the cam grooves 34 of the lever 30, the female housing 71 moves to an inner side of the hood part 21*a* together with the moving plate 40, so that the female housing 71 is fitted into the male housing 21.

Figure 3:
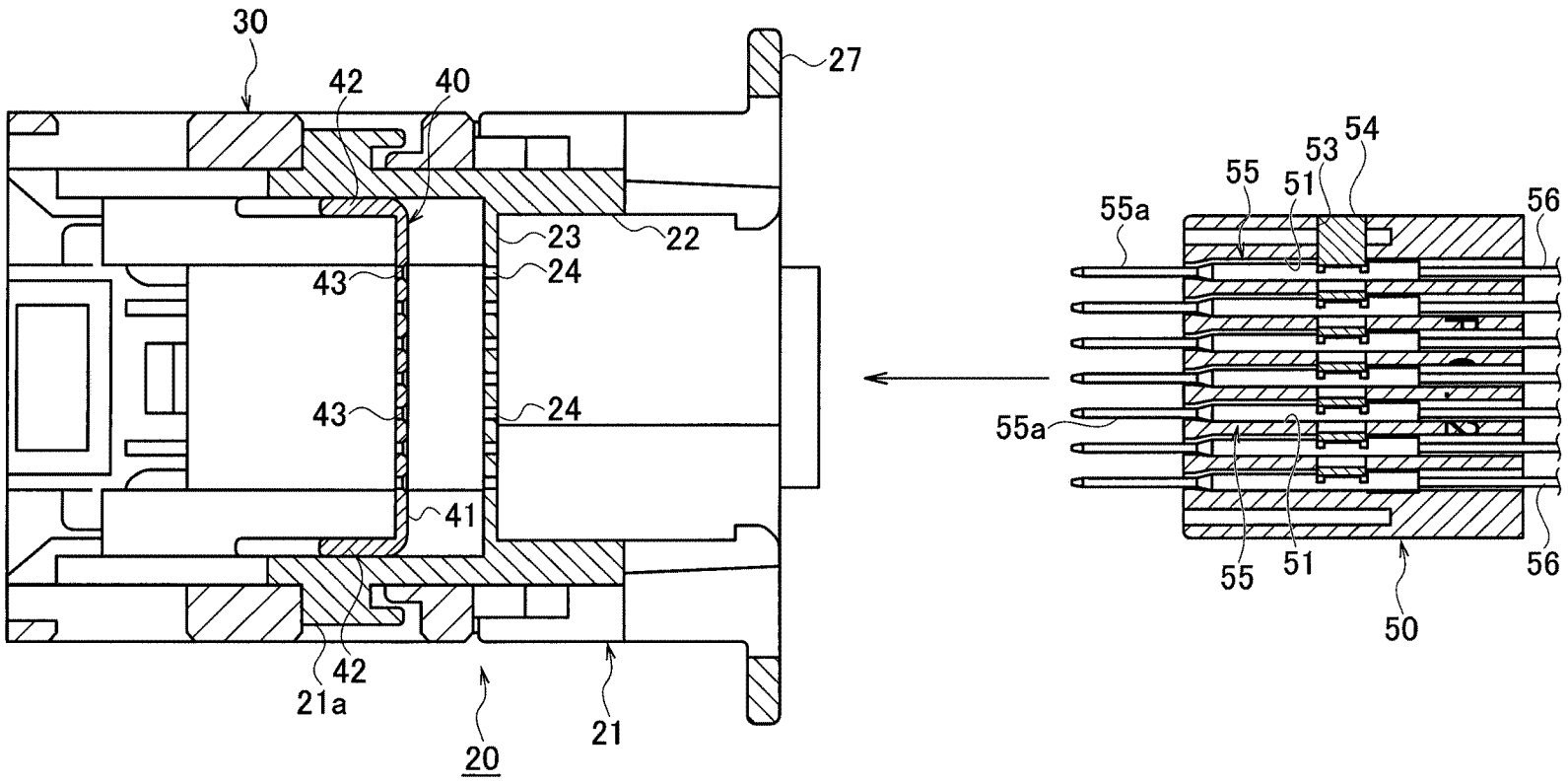
FIG. 3 is a sectional view of the male connector of the lever type connector according to the first embodiment, illustrating the state before assembling.
Figure 4A:
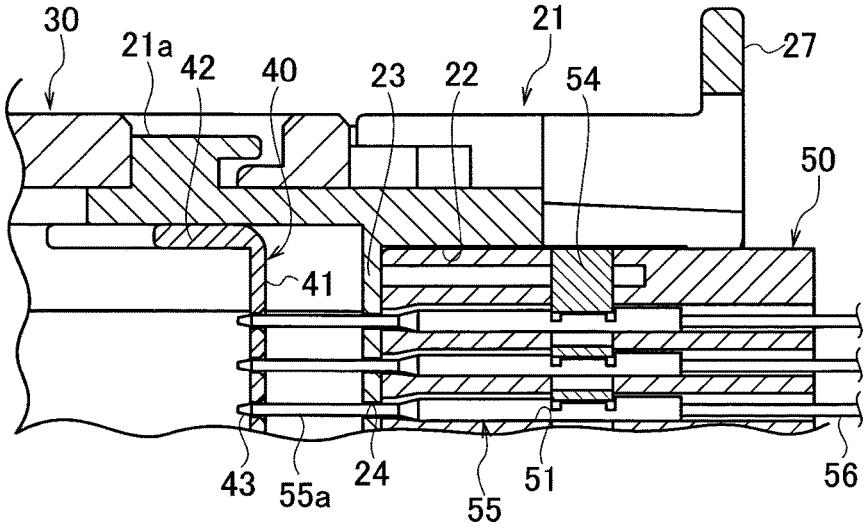
FIG. 4A is a sectional view of an essential part at a time of assembling the male connector of the lever type connector according to the first embodiment.
Figure 4B:
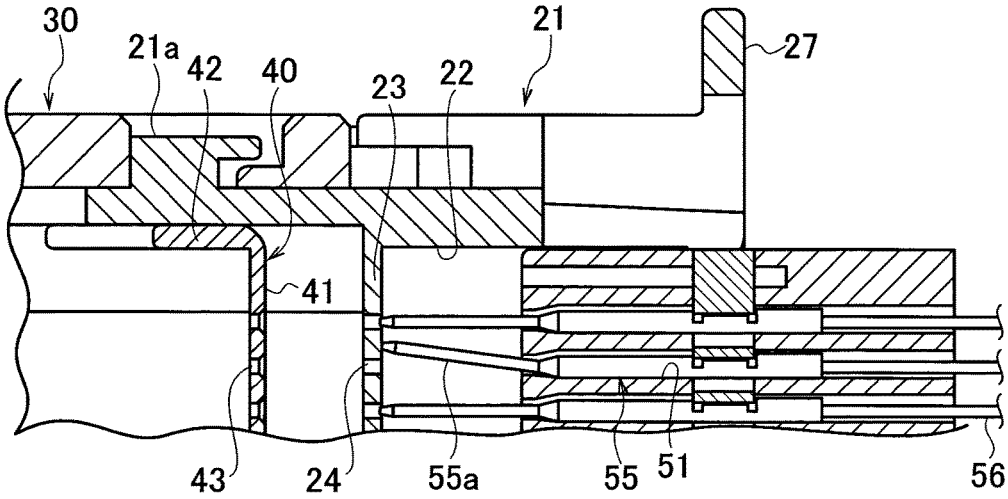
FIG. 4B is a sectional view of the essential part at the time of assembling the male connector in a case that there is a deformation in male terminals of the lever type connector according to the first embodiment.

The male housing 21 is made of synthetic resin. As illustrated in FIGS. 3, 4A, and 4B, a partition wall 23 separating between the hood part 21*a* and the sub-housing accommodating chamber 22 of the male housing 21 is provided with a plurality of tab insertion holes 24 as a tab deformation detecting mechanism (aligning structure) for allowing an insertion of the tab parts 55*a* of the male terminals 55. Each of the tab insertion holes 24 is formed in the same position as the position of corresponding positioning hole 43 formed in the moving plate 40 to allow an insertion of the tab part 55*a* of the male terminal 55. Additionally, each of the tab insertion holes 24 is formed with the same hole diameter as that of each of the positioning holes 43.

As illustrated in FIGS. 4A and 4B, the deformation of the tab part 55*a* of each of the male terminals 55 accommodated and held in corresponding cavity 51 of the male sub-housing 50 is detected by each of the tab insertion holes 24. That is, as illustrated in FIG. 4A, when there is no deformation in the tab part 55*a* of each of the male terminals 55, the tab part 55*a* of each of the male terminals 55 can pass through each of the tab insertion holes 24. As a result, the male sub-housing 50 can be fitted into the sub-housing accommodating chamber 22 of the male housing 21. On the other hand, as illustrated in FIG. 4B, when there is a deformation in a tab part 55*a* of one of the male terminals 55, the tab part 55*a* of one of the male terminals 55 cannot penetrate corresponding tab insertion hole 24. Thus, as it is impossible to fit the male sub-housing 50 into the sub-housing accommodating chamber 22 of the male housing 21, the deformation of the tab part 55*a* of one of the male terminals 55 accommodated and held in corresponding cavity 51 of the male sub housing 50 is detected.

As illustrated in FIGS. 1, 2, 5, and 6, the hood part 21*a* is formed, at the center of its both sidewalls, with a pair of notched groove parts 25 for temporarily locking the lever 30. The notched groove parts 25 serve as guide rails which guide the movements of a pair of bosses 44 of the moving plate 40 and a pair of first guide protrusions 76 of the female housing 71.

Figure 9:
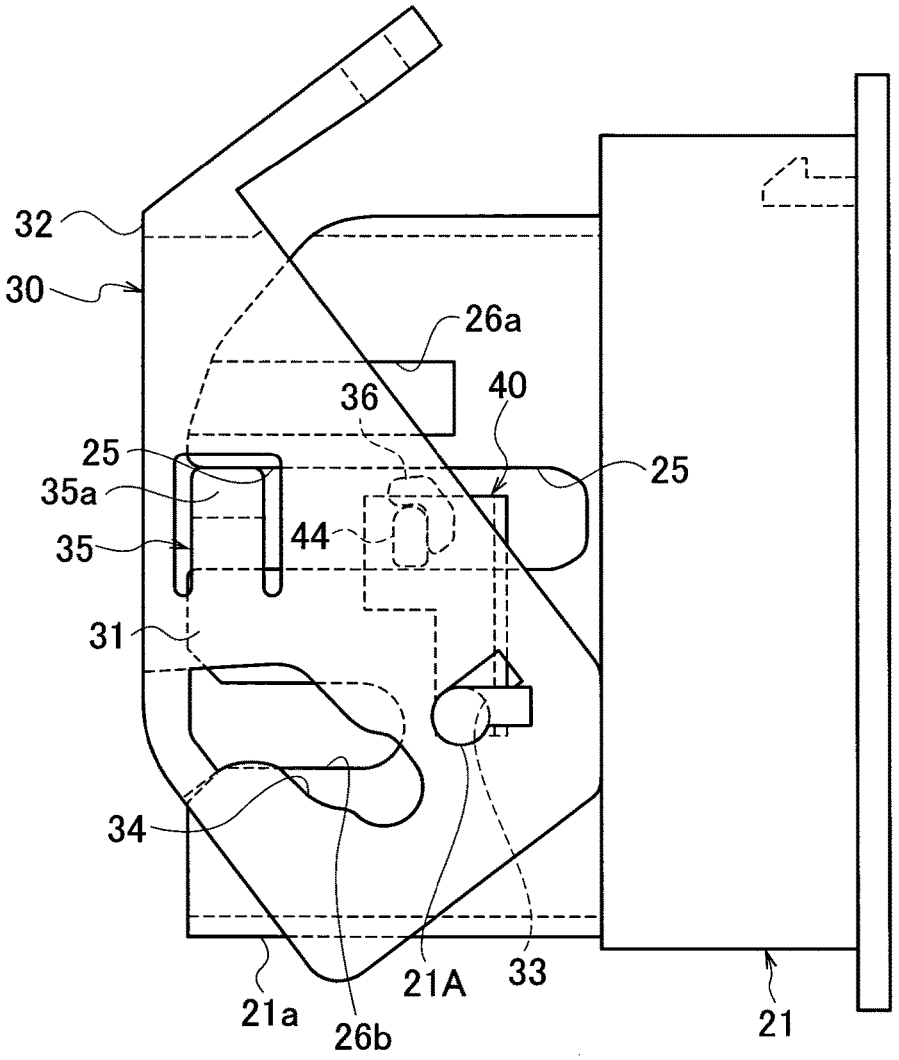
FIG. 9 is a side view when the pull-up of the moving plate is completed (in temporary lever locking) by the backward operation of the lever of the lever type connector according to the first embodiment.

The hood part 21*a* is provided, at respective positions interposing the pair of notched groove parts 25, with a pair of recessed receiving grooves 26*a* which allow entering locking protrusions 35*a* of elastic locking pieces 35 of the lever 30 and a pair of notched receiving grooves 26*b* which allow entering second guide protrusions 77 of the female housing 71. As illustrated in FIG. 9, when the lever 30 is in a temporarily-locked state, the pair of locking protrusions 35*a* of the lever 30 are locked to groove surfaces of the pair of notched groove parts 25.

On the outer periphery of the rear end of the male housing 21, an annular flange part 27 is integrally formed so as to protrude from the rear end. A rubber grommet (not illustrated) having annular seal part on its front side is prepared, and a groove of the annular seal part is fitted the annular flange part 27. On the outer periphery of the rear end of the male housing 21, a pair of upper locking protrusions 28, 28 and a pair of lower locking protrusions 28, 28 are formed so as to integrally protrude from the rear end. When the male housing 21 passes through an attachment hole of a panel (not illustrated) of the vehicle from its door side, the distal ends of respective pairs of locking protrusions 28, 28 of the male housing 21 are locked onto a body-side surface around the attachment hole of the panel of the vehicle. In this way, the lever type connector 10 is attached to the attachment hole of the panel of the vehicle in a sealed state, through the annular seal part on the front side of the grommet.

Figure 5A:
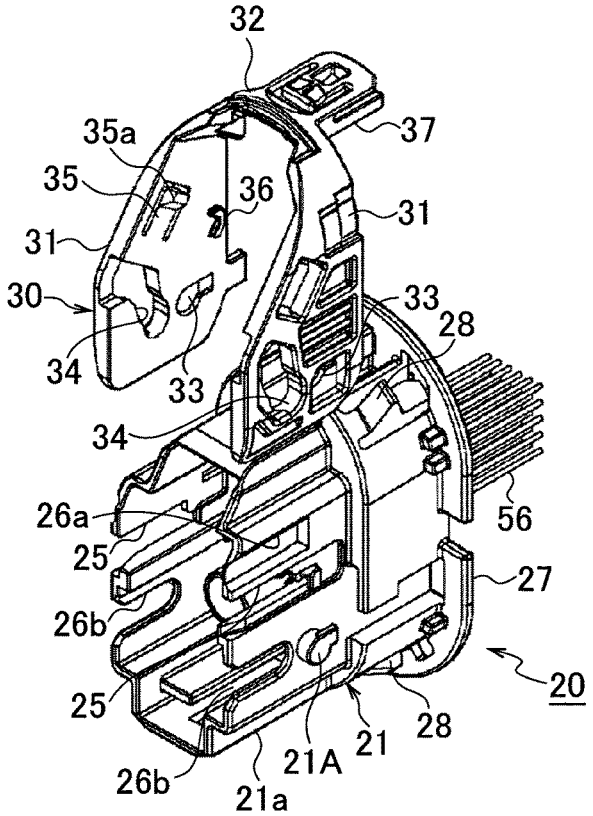
FIG. 5A is a perspective view of a state before assembling a lever to the male connector of the lever type connector according to the first embodiment.
Figure 5B:
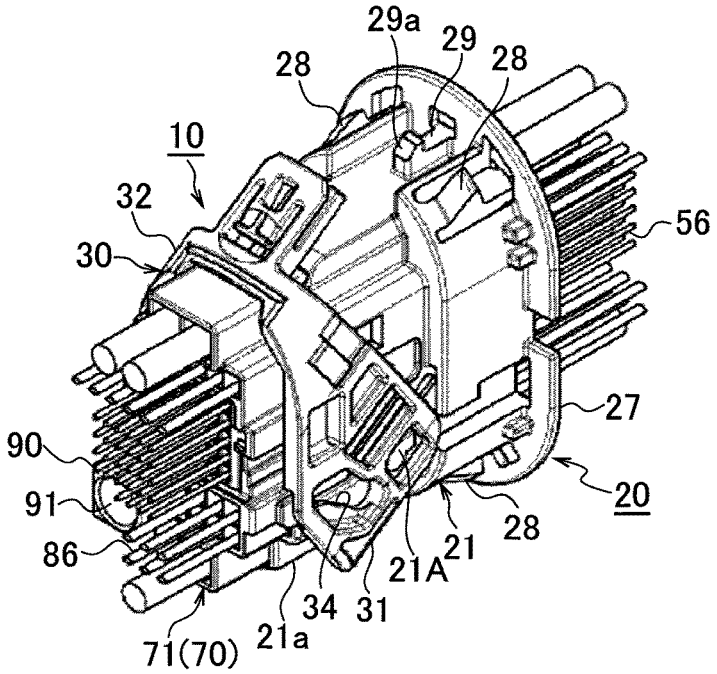
FIG. 5B is a perspective view illustrating a state where a female connector is set to the male connector of the lever type connector according to the first embodiment.
Figure 6:
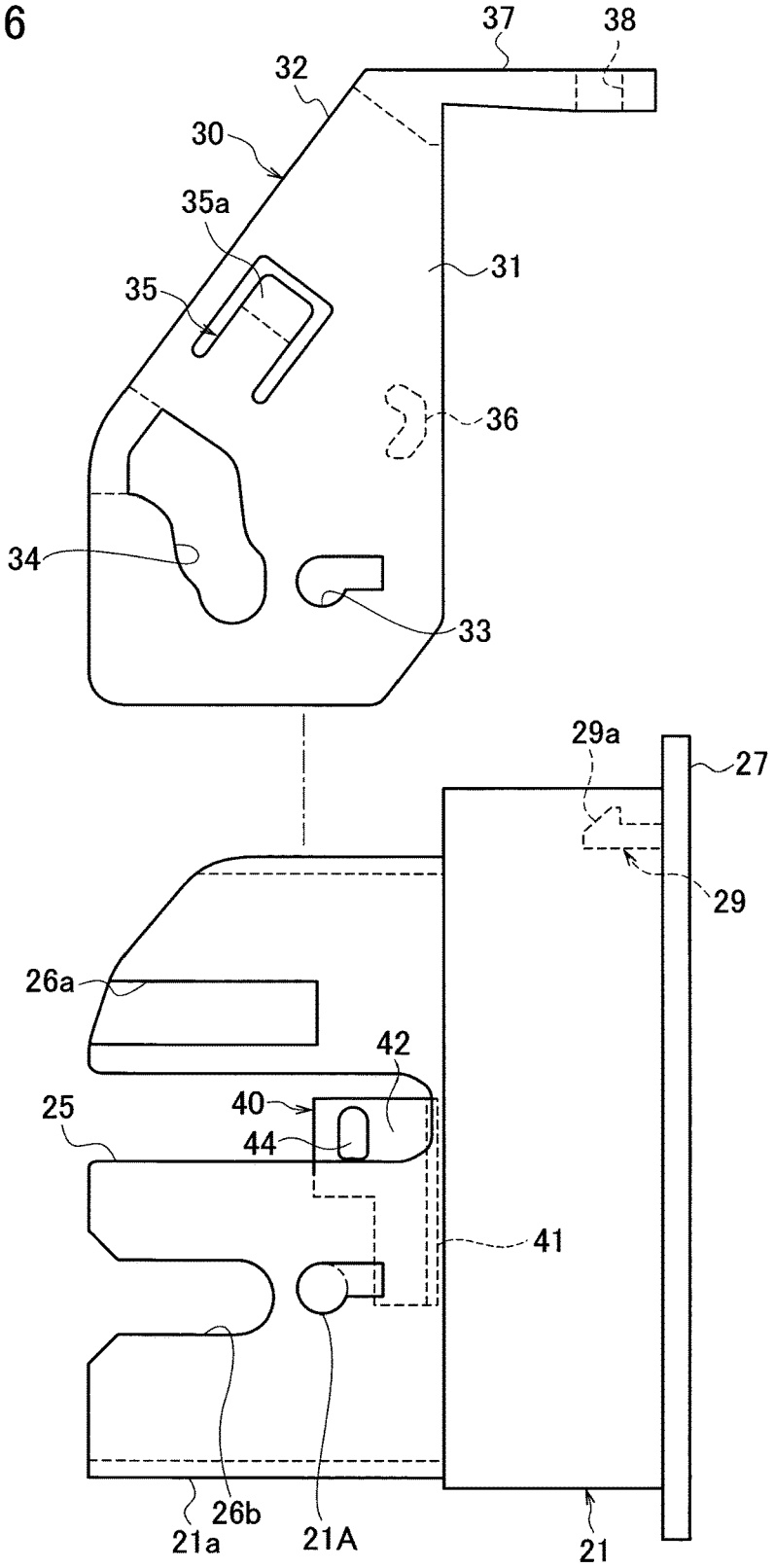
FIG. 6 is a side view of a state before assembling the lever to the male connector of the lever type connector according to the first embodiment.

As illustrated in FIGS. 5A, 5B, and 6, the male housing 21 has an elastic locking piece 29 integrally formed so as to project from the upside center of the flange part 27 and also provided with a locking protrusion 29*a*. The locking protrusion 29*a* is adapted so as to be lockable to and detachable from a locking hole 38 formed in a protruding piece 37 of the lever 30.

As illustrated in FIGS. 1, 2, 5, and 6, the lever 30 includes a pair of arm parts 31 and an operating part 32 connecting the pair of arm parts 31 and is formed in one body made of synthetic resin. The respective arm parts 31 have bearing holes 33 formed to rotatably support pivot shafts 21A integrally formed on both sides of the hood part 21*a*. In each of the arm parts 31, a cam groove 34 is formed so as to be engaged with corresponding cam follower 75 formed in the female housing 71.

Figure 12:
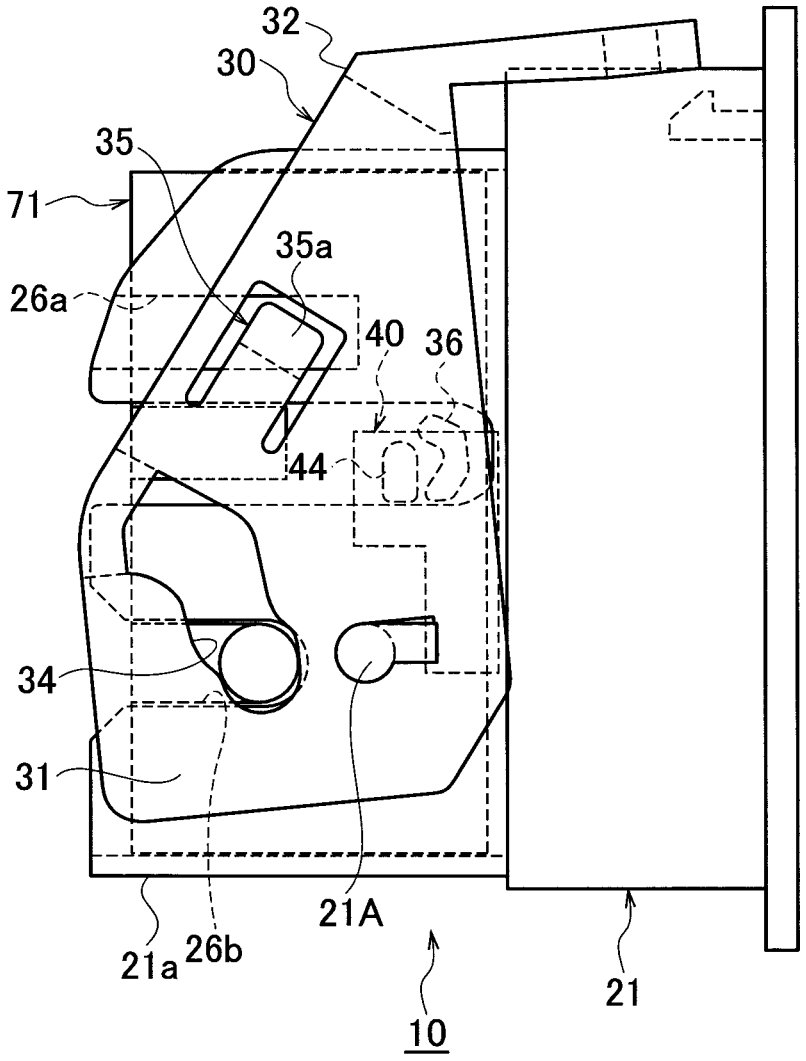
FIG. 12 is a side view during the forward operation of the lever of the lever type connector according to the first embodiment.
Figure 13:
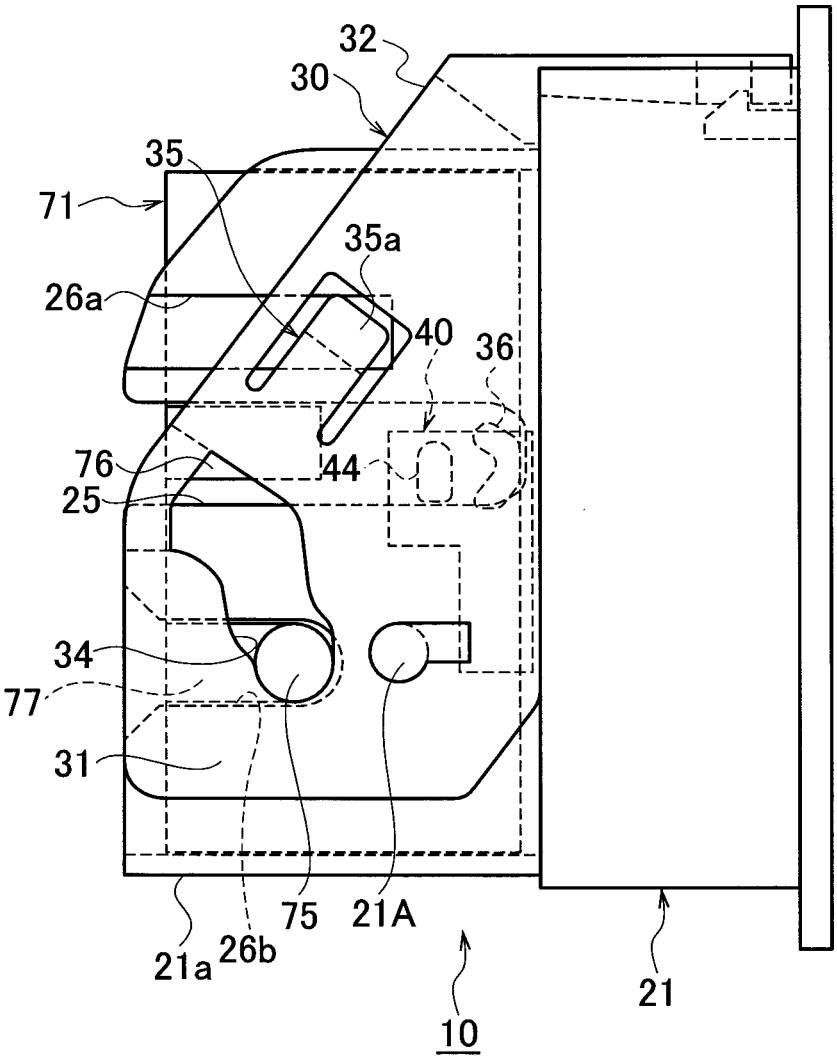
FIG. 13 is a side view when the forward operation of the lever of the lever type connector according to the first embodiment is completed (i.e. when the fitting operation is completed).
Figure 15:
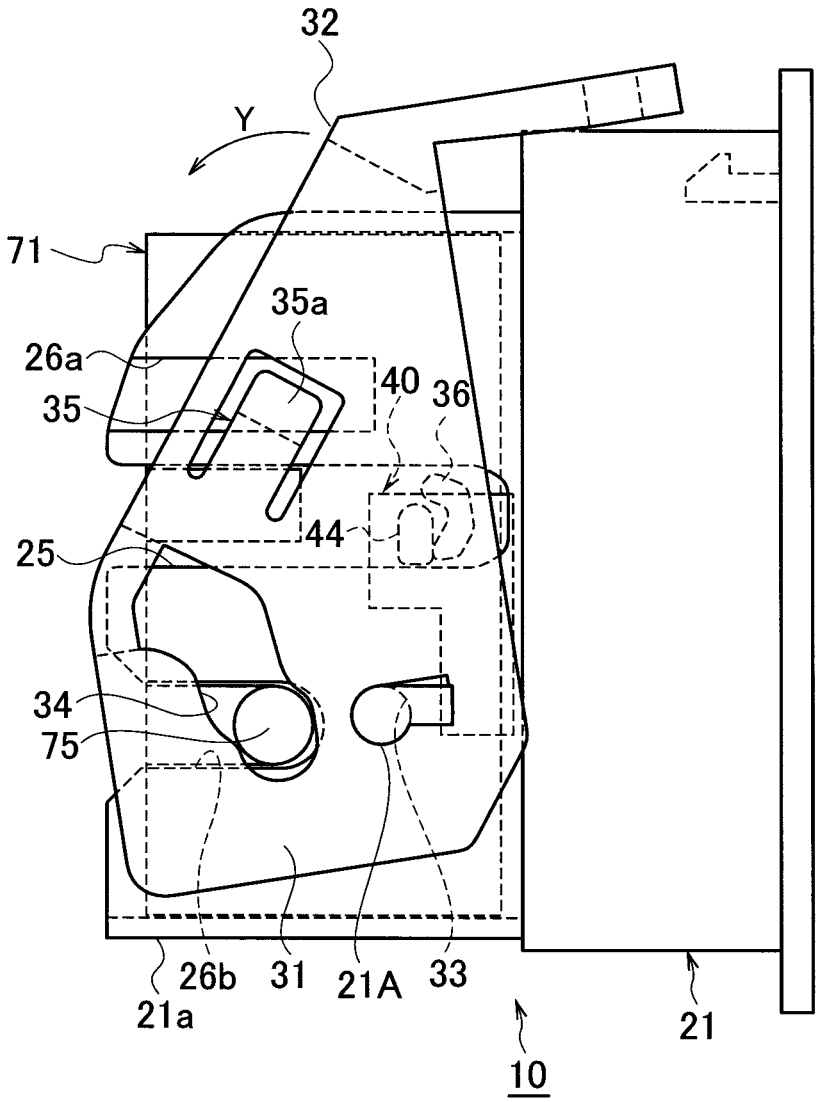
FIG. 15 is a side view at the beginning of pulling up the moving plate by the backward operation of the lever of the lever type connector according to the first embodiment.
Figure 16:
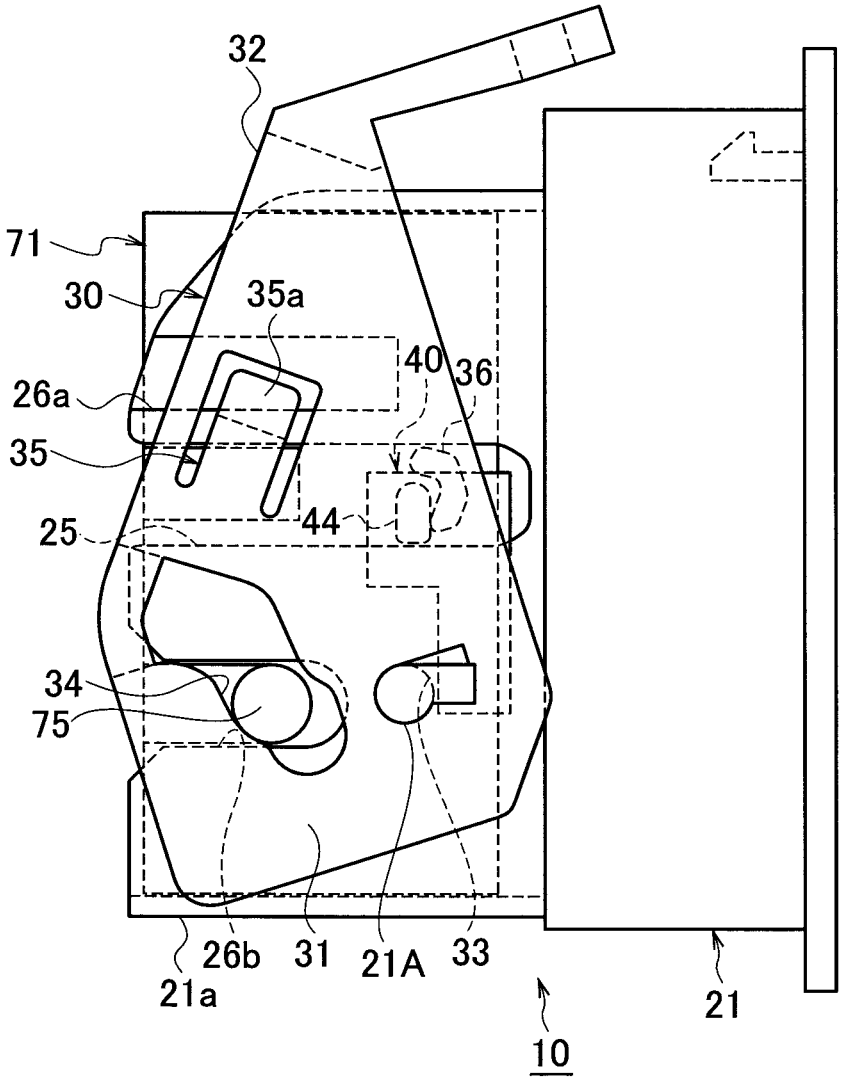
FIG. 16 is a side view during the pull-up of the moving plate by the backward operation of the lever of the lever type connector according to the first embodiment.
Figure 17:
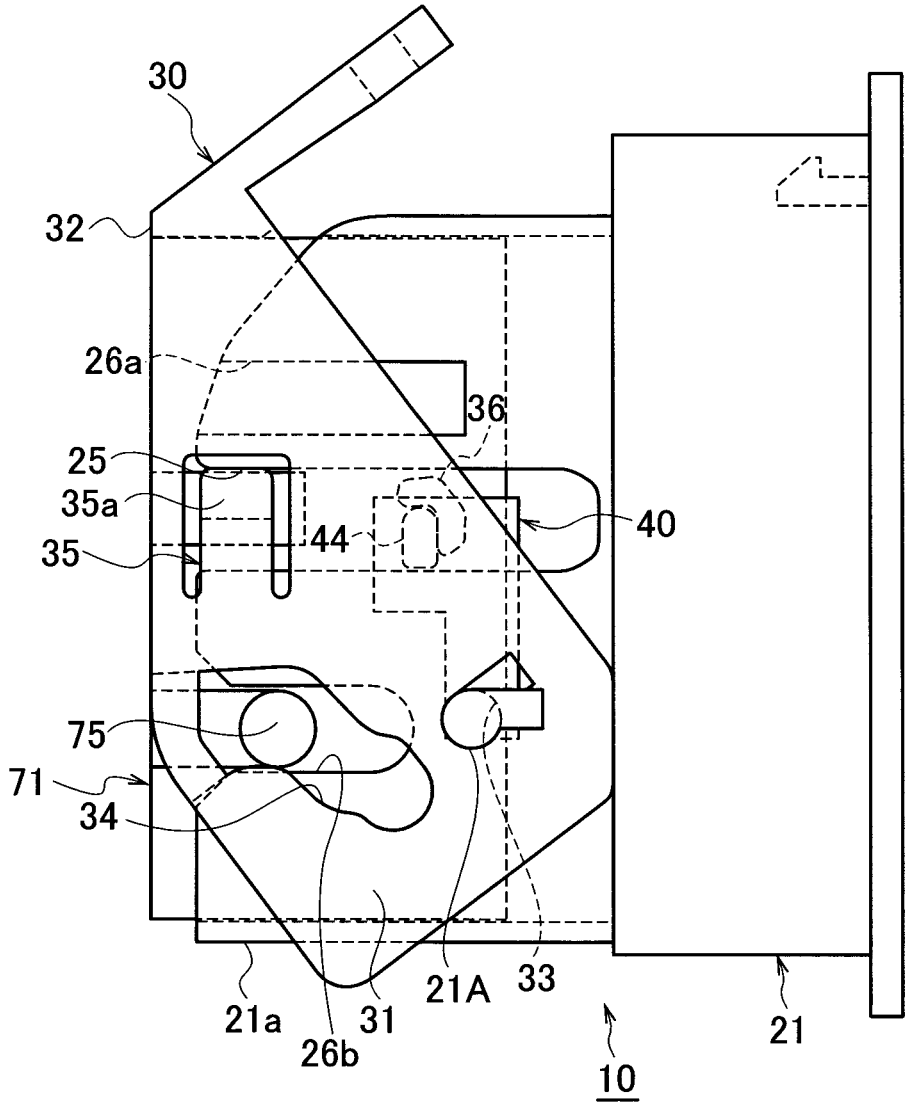
FIG. 17 is a side view when the pull-up of the moving plate by the backward operation of the lever of the lever type connector according to the first embodiment is completed (i.e. when the detachment operation is completed).
Figure 18:
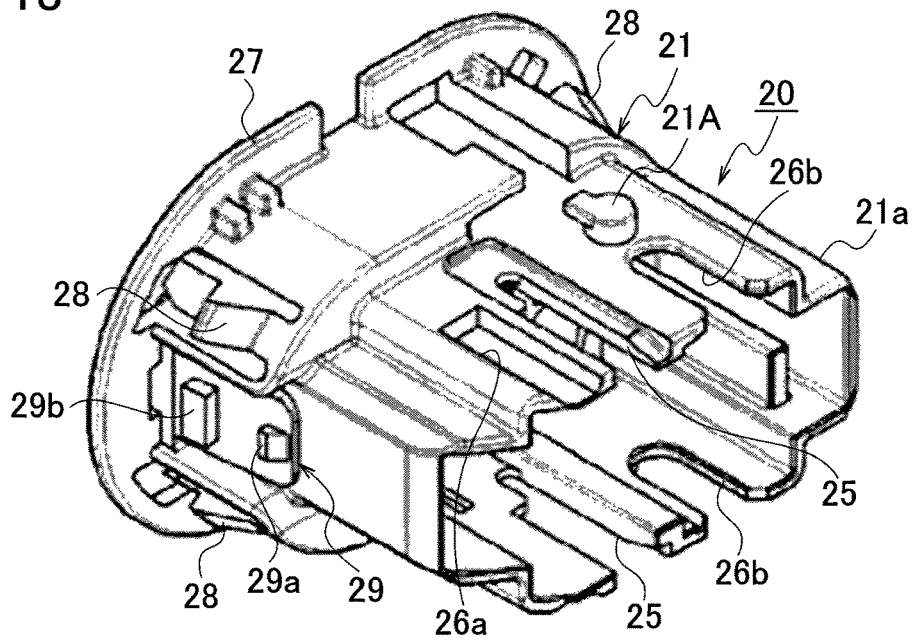
FIG. 18 is a perspective view of a male connector of a lever type connector according to a second embodiment.
Figure 19:
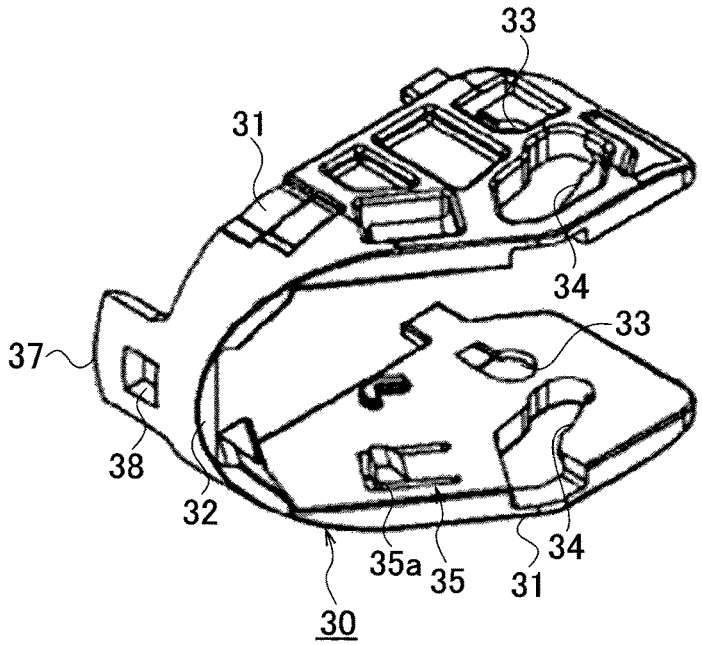
FIG. 19 is a perspective view of a lever attached to the male connector of the lever type connector according to the second embodiment.
Figure 20:
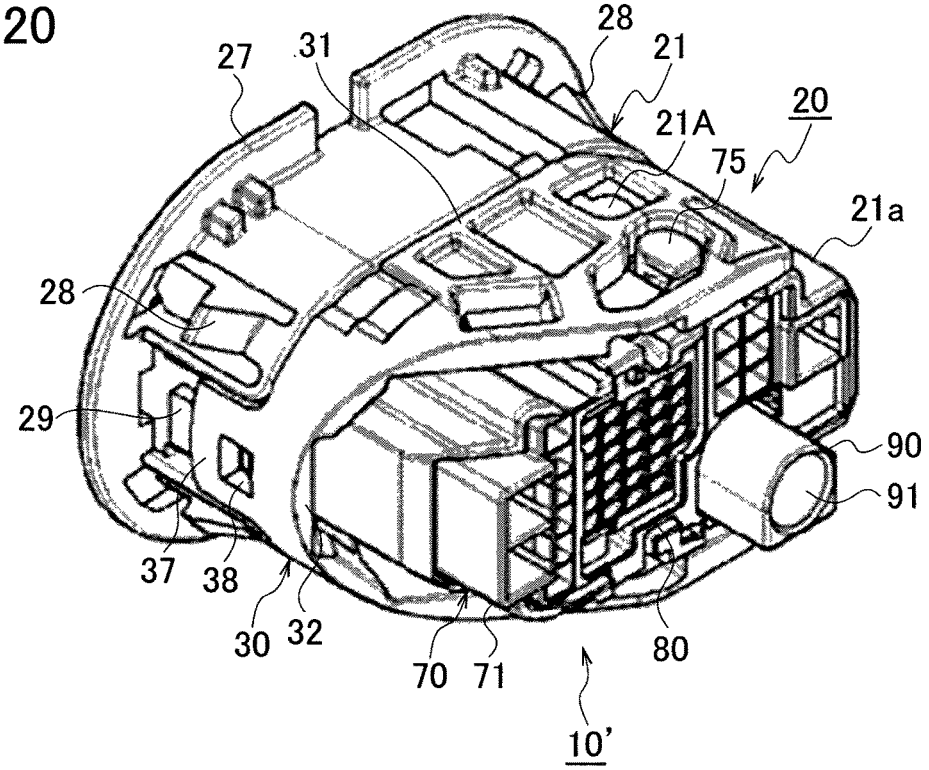
FIG. 20 is a perspective view of the lever type connector according to the second embodiment.
Figure 21A:
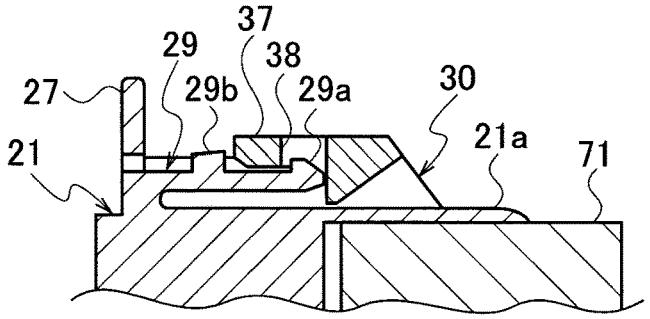
FIG. 21A is a sectional view of an essential part when the male connector and the lever of the lever type connector according to the second embodiment are locked to each other.
Figure 21B:
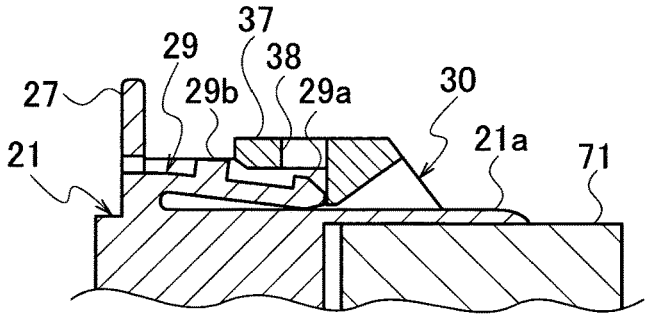
FIG. 21B is a sectional view of the essential part when the locking between the male connector and the lever of the lever type connector according to the second embodiment is released.
Figure 22:
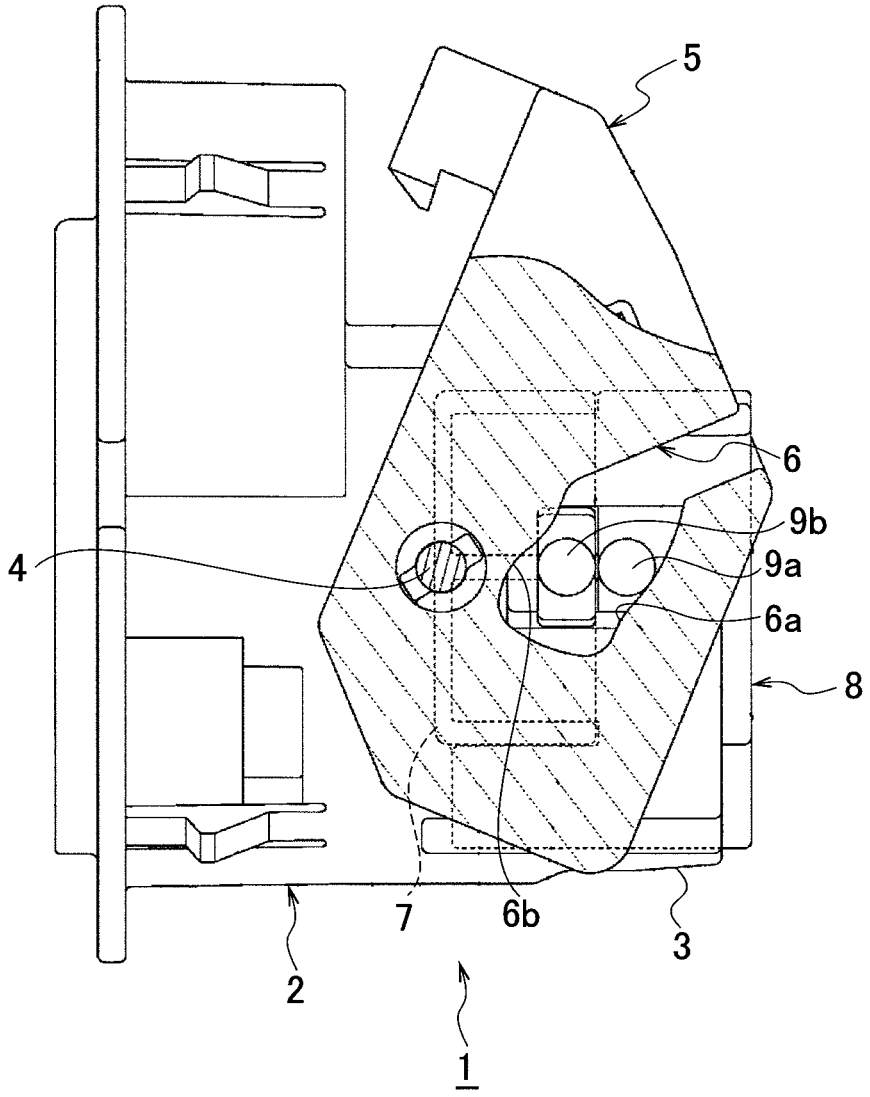
FIG. 22 PRIOR ART
FIG. 22 is a side view illustrating a state where a lever type connector of a conventional example is in the middle of fitting, in the form of a partially-breakaway view.

As illustrated in FIGS. 11 to 13, by operating the operating part 32 of the lever 30 forward (indicated with an arrow X in the figure), the male housing 21 and the female housing 71 are fitted to each other with a low insertion force through the cam grooves 34 and the cam followers 75. As illustrated in FIGS. 15 to 17, by operating the operating part 32 of the lever 30 backward (indicated with an arrow Y in the figure), the male housing 21 and the female housing 71 are detached from each other with a low insertion force through the cam grooves 34 and the cam followers 75.

Figure 14:
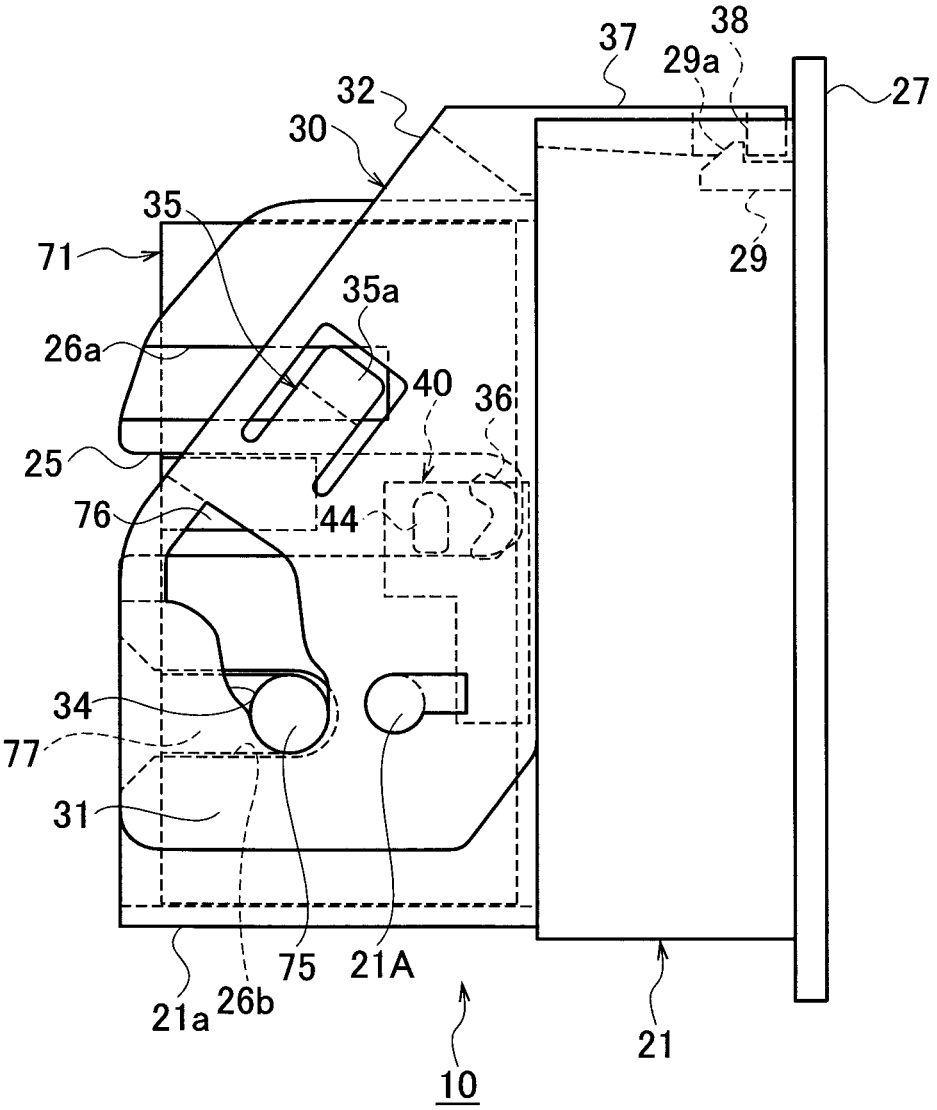
FIG. 14 is a side view before the beginning of the forward operation of the lever when detaching the female connector from the male connector of the lever type connector according to the first embodiment.

In each of the arm parts 31, the elastic locking piece 35 having the locking protrusion 35*a* is notched. With the pair of locking protrusions 35*a* being elastically locked to the pair of notched grooves 25 formed in the sidewalls of the hood part 21*a*, the lever 30 is held in the temporary locking position illustrated in FIGS. 9 and 17. Furthermore, with the pair of locking protrusions 35*a* being locked to the groove surfaces of the pair of receiving grooves 26*a* formed on the sidewalls of the hood part 21*a*, the lever 30 is held in a rotation regulating position as illustrated in FIGS. 13 and 14.

Figure 10:
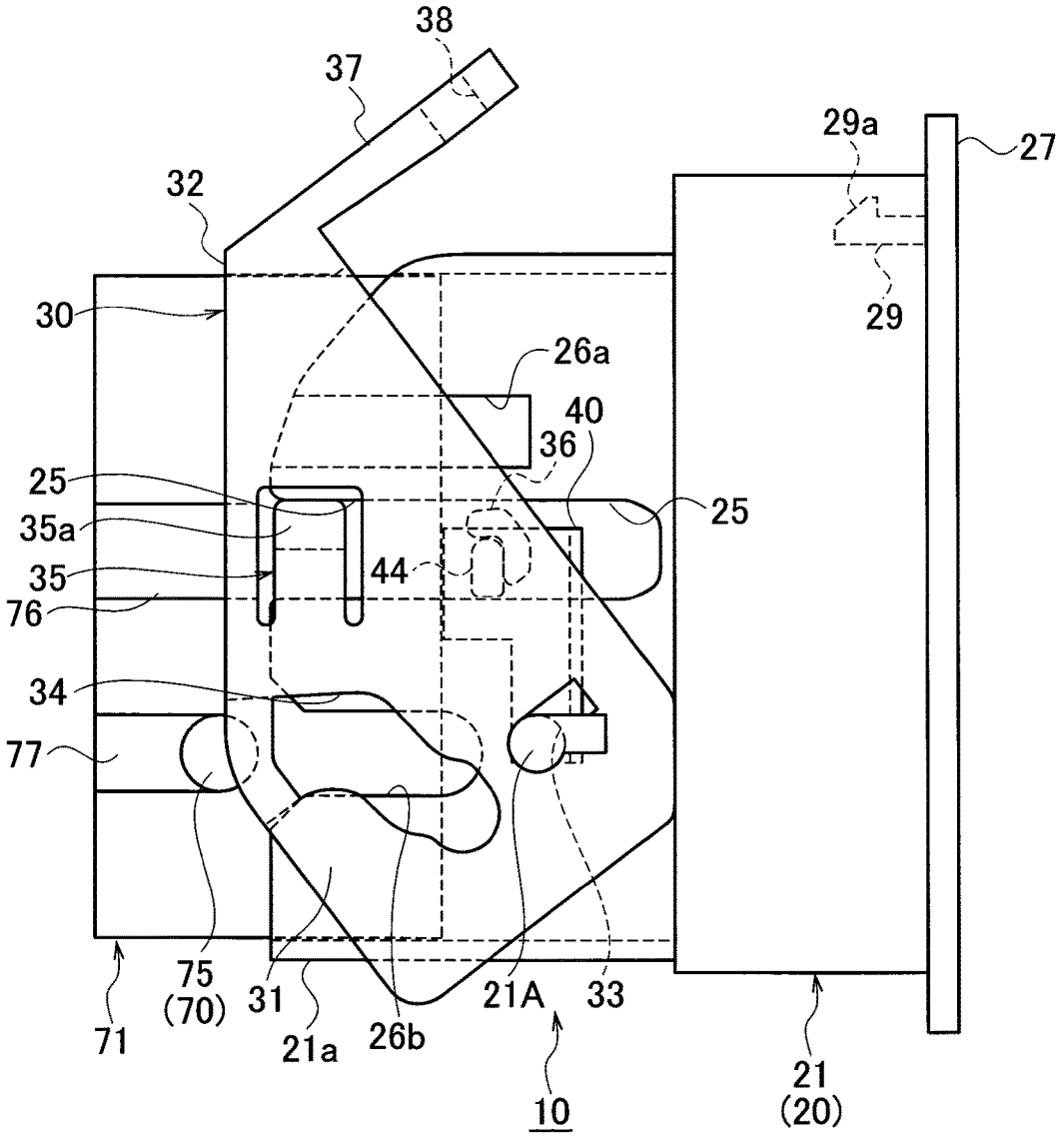
FIG. 10 is a side view illustrating a non-fitted state where the female connector is set to the male connector of the lever type connector according to the first embodiment.

As illustrated in FIGS. 1, 5, and 6, each of the arm parts 31 has a rib 36 integrally formed so as to project from an inner surface of the part 31. When the female housing 71 is not fitted (when the lever 30 is in the temporarily-locked state as illustrated in FIG. 9 and when the female housing 71 is set temporarily as illustrated in FIG. 10), the ribs 36 abut against the bosses 44 formed on the moving plate 40. Then, when the abutment between the ribs 36 and the bosses 44 is released by the forward operation of the lever 30 (indicated with the arrow X in the drawing), the female housing 71 is allowed to push the moving plate 40 into the hood part 21*a*. Each of the ribs 36 is L-shaped so as to surround a part of corresponding boss 44 (its upper side and the rear side). When the female housing 71 is detached from the male housing 21, the ribs 36 abut against the bosses 44. In this state, by the backward operation of the lever 30 (indicated by the arrow Y in the figure), the moving plate 40 returns to the original position of draw-up completion, as illustrated in FIGS. 9 and 17.

As illustrated in FIGS. 5A, 5B, and 6, the protruding piece 37 is integrally formed at the center of the operating part 32 of the lever 30. The projecting piece 37 is formed with the locking hole 38 for locking the locking protrusion 29*a* of the elastic locking piece 29 of the male housing 21.

As illustrated in FIGS. 10 to 13, the moving plate 40 is movable between an initial position located on the opening side of the hood part 21*a* and a fitting position located on the inner side of the hood part 21*a*. The moving plate 40 is made of synthetic resin. As illustrated in FIGS. 1 and 6, the moving plate 40 consists of a plate body 41 in the form of a rectangular flat plate and a pair of sidewall parts 42 projecting from both sides of the plate body 41 forward, providing a U-shaped integrated element. The plate body 41 is provided with a plurality of aligned positioning holes 43.

As illustrated in FIG. 4A, when the moving plate 40 is in the initial position, respective axes of the tab parts 55*a* are prevented from being deflected since respective tips of the tab parts 55*a* of the male terminals 55 are inserted into the positioning holes 43 in their positioned state. Then, as the moving plate 40 moves toward the fitting position, the projection amounts of the tab parts 55*a* from the positioning holes 43 toward the front increase gradually.

On the upper front side of each of the sidewall parts 42, the boss 44 which can abut on and depart from corresponding rib 36 of the lever 30 is formed integrally with the sidewall part 42. Each of the sidewall parts 42 is integrally formed, on its center rear side, with a lock part 45 which is elastically locked onto the inner surface of the sidewall of the hood part 21*a* to lock the moving plate 40 temporarily.

As illustrated in FIGS. 1 to 4, the male sub-housing 50 is formed to be a substantially rectangular block of synthetic resin, and is inserted into the sub-housing accommodating chamber 22 of the male housing 21 from behind. Inside the male sub-housing 50, the plurality of cavities 51 capable of accommodating the male terminals 55 connected to respective terminals of electric wires 56 are formed so as to penetrate the male sub-housing 50 in the forward and backward direction. On an inner wall of each of the cavities 51, a flexible lance (not illustrated) is formed to prevent corresponding male terminal 55 from being dropped out of each of the cavities 51. In the male sub-housing 50, a spacer mount hole 53 in communication with the cavities 51 is formed so as to open on a top surface of the male sub-housing 51. When the spacer 54 is inserted into the spacer mount hole 53 from above, the male terminals 55 are doubly locked by the lances (not illustrated) and the spacer 54 inserted into the spacer mounting hole 53, however, up to the normal depth.

As illustrated in FIG. 1, the male coaxial sub-housing 60 is shaped in the form of a substantially block of synthetic resin, which is elongated in the forward and backward direction. The male coaxial sub-housing 60 is inserted into the sub-housing insertion hole (not illustrated) of the male housing 21 from behind. The male coaxial sub-housing 60 is provided, at its center, with a cavity 61 for accommodating a coaxial terminal (not illustrated). On the inner wall of the cavity 61 of the male coaxial sub-housing 60, a flexible lance 62 to be locked to the coaxial terminal (not illustrated) is integrally formed so as to project from the inner wall.

As illustrated in FIG. 1, the female housing 71 is shaped in the form of a rectangular box of synthetic resin. At the substantially center of the female housing 71, the sub-housing accommodating chamber 72 for accommodating the female sub-housing 80 and the sub-housing insertion hole 73 for accommodating the female coaxial sub-housing 90 are formed so as to penetrate the female housing 71 in the forward and backward directions, respectively. Around the sub-housing accommodating chamber 72 and the sub-housing insertion hole 73 of the female housing 71, terminal accommodating chambers 74*a*, 74*b* for accommodating power supply circuit terminals (not illustrated) and signal circuit terminals (not illustrated) are formed so as to penetrate the female housing 71 in the forward and backward directions.

At the substantially center of each side surface of the female housing 71, the pin-shaped cam follower 75 to be engaged with corresponding cam groove 34 of the lever 30 is integrally formed so as to project from female housing 71.

On each side surface of the female housing 71, the first guide protrusion 76 that enters the notched groove 25 of the hood part 21*a* and the guide protrusion 77 that enters the notched receiving groove 26*b* of the hood part 21*a* are formed so as to project from female housing 71 integrally.

As illustrated in FIG. 1, the female sub-housing 80 is shaped in the form of a substantially rectangular block of synthetic resin. The female sub-housing 80 is inserted into the sub-housing accommodating chamber 72 of the female housing 71 from behind. Inside the female sub-housing 80, a plurality of cavities 81 capable of accommodating the female terminals 85 connected to respective terminals of electric wires 86 are formed so as to penetrate the female sub-housing 80 in the forward and backward direction. On an inner wall of each of the cavities 81, the flexible lance (not illustrated) is formed to prevent corresponding female terminal 85 from being dropped out of each of the cavities 81. In the female sub-housing 80, a spacer mount hole (not illustrated) in communication with the cavities 81 is formed so as to open on a top surface of the female sub-housing 80. When a spacer 84 is inserted into the spacer mount hole from above, the female terminals 85 are doubly locked by the lances (not illustrated) and the spacer 84 inserted into the spacer mounting hole, however, up to the normal depth.

As illustrated in FIG. 1, the female coaxial sub-housing 90 is shaped in the form of a substantially block of synthetic resin, which is elongated in the forward and backward direction. The female coaxial sub-housing 90 is inserted into the sub-housing insertion hole 73 of the female housing 71 from behind. The female coaxial sub-housing 90 is provided, at its center, with a cavity 91 for accommodating a coaxial terminal (not illustrated). On the inner wall of the cavity 91, a flexible lance 92 to be locked to the coaxial terminal (not illustrated) is integrally formed so as to project from the inner wall.

Figure 7:
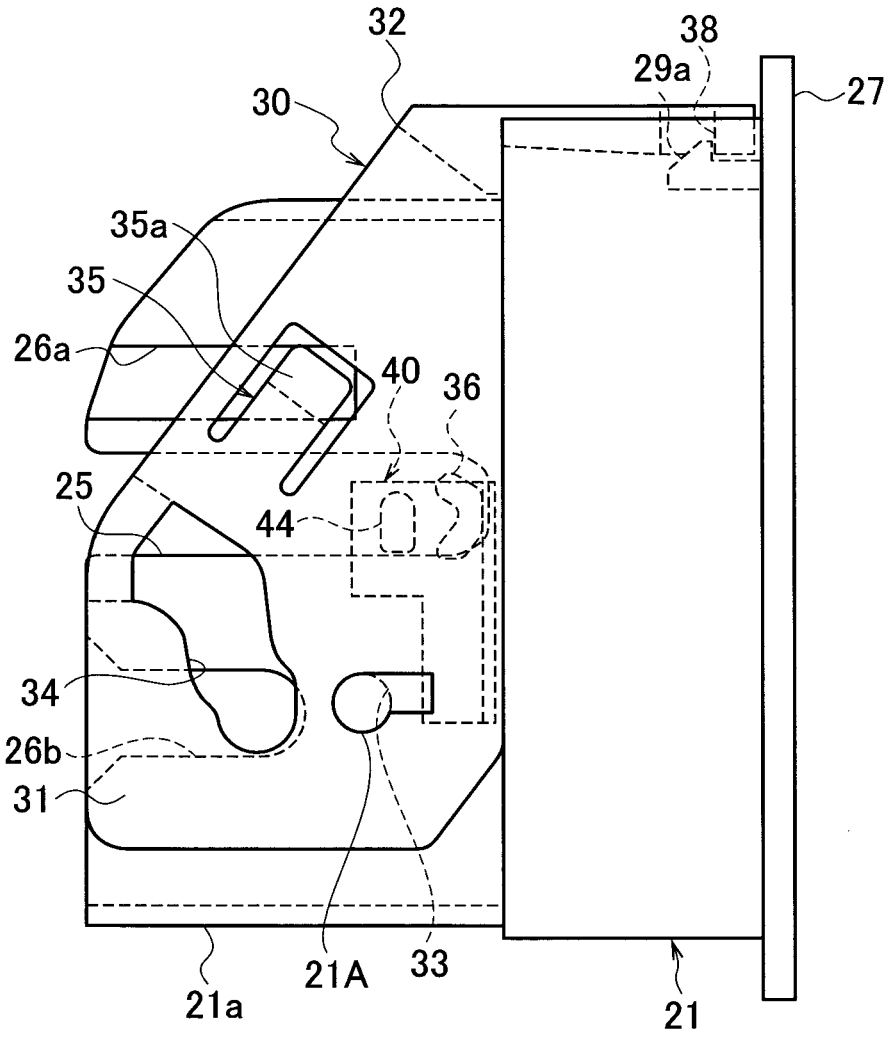
FIG. 7 is a side view of a state where the lever is assembled to the male connector of the layer type connector according to the first embodiment.

In the lever type connector 10 according to the first embodiment, as illustrated in FIGS. 6 and 7, the lever 30 and the moving plate 40 are assembled to the male housing 21. At this time, the ribs 36 of the lever 30 and the bosses 44 of the moving plate 40 are separated from each other.

Figure 8:
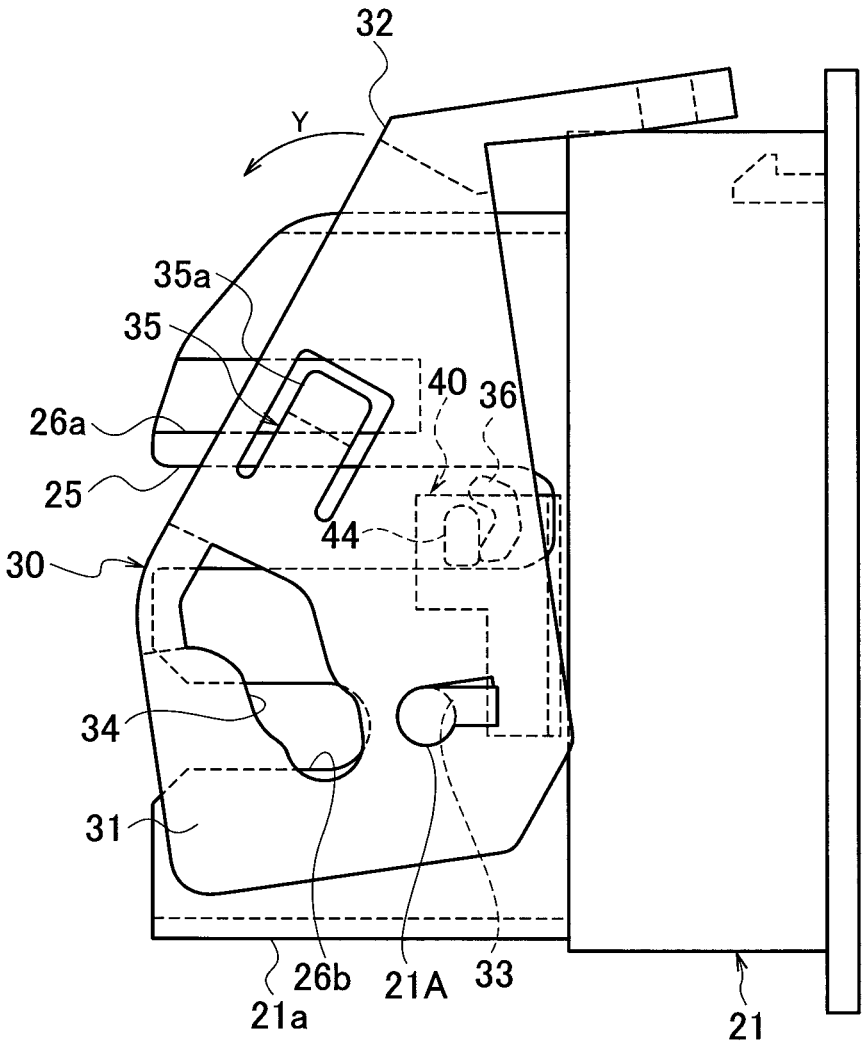
FIG. 8 is a side view at the beginning of pulling up a moving plate by the backward operation of the lever of the lever type connector according to the first embodiment.

Then, as illustrated in FIG. 8, when the lever 30 is operated backward in the Y direction, the ribs 36 of the lever 30 abut against the bosses 44 of the moving plate 40 and press them, thereby drawing up the moving plate 40 to return it to the initial position (original position), as illustrated in FIG. 9. At this time, the lever 30 is brought into the temporarily-locked state since the pair of locking protrusions 35*a* of the lever 30 is elastically locked to the groove surfaces of the pair of notched groove parts 25 of the hood part 21*a*. As the ribs 36 of the lever 30 abut against the bosses 44 of the moving plate 40 when the lever 30 is in the temporarily-locked state, the moving plate 40 is prevented from being pushed into the hood part 21*a*. That is, the ribs 36 of the lever 30 prevent the moving plate 40 from moving to the inner side in the hood part 21*a*.

As illustrated in FIG. 11, when forward-operating the lever 30 in the X direction from the state of FIG. 10 where the female housing 71 is set in the hood part 21*a* (in the non-fitting state of the female housing 71), the ribs 36 of the lever 30 move and separate from the bosses 44, so that the moving plate 40 becomes possible to move, as illustrated in FIG. 12. Then, as illustrated in FIG. 13, the female housing 71 moves to the inner side in the hood part 21*a* together with the moving plate 40 and is fitted into the male housing 21.

In this way, although the ribs 36 abut against the bosses 44 of the moving plate 40 in the non-fitted state of the female housing 71, such an abutment between the bosses 44 and the ribs 36 is released by the forward movement of the lever 30 in the X direction, so that it becomes possible for the female housing 71 to push the moving plate 40 into the hood part 21*a*. Owing to the provision of the protruding ribs 36 on the arm parts 31 of the lever 30, when the lever 30 is in the temporarily-locked state, the moving plate 40 is prevented from being pushed into the hood part 21*a* by the ribs 36. Additionally, by forward-operating the lever 30 in the X direction, it is possible to move the female housing 71 together with the moving plate 40 to the inner side of the hood part 21*a* and also possible to fit the male housing 21 and the female housing 71 to each other with a low insertion force.

As illustrated in FIGS. 14 to 17, when detaching the male housing 21 from the female housing 71, the L-shaped ribs 36 of the lever 30 operate to draw the bosses 44 of the moving plate 40 due to their configuration and pull up the moving plate 40 with the backward operation of the lever 30 in the Y direction, thereby returning the moving plate 40 to the original position outside the hood part 21*a*.

In this way, with the lever type connector 10, the movement of the moving plate 40 into the hood part 21*a* is neither restricted nor permitted by the cam grooves 34 of the lever 30 but restricted or permitted by allowing the bosses 44 of the moving plate 40 to abut against or separate from the ribs 36 of the lever 30. Thus, the constraints in the positional relationship between the lever 30 and the moving plate 40 when replacing the lever 30 or the moving plate 40 are eliminated to allow the assembling operation of the lever 30 or the moving plate 40 to be performed in a short time. As a result, it is possible to prevent the lever 30 or the moving plate 40 from being damaged or broken in a case of replacing these components, reliably.

Additionally, the lever type connector 10 is constructed so that the ribs 36 of the lever 30 abut against the bosses 44 of the moving plate 40 when detaching the female housing 71 from the male housing 21 and subsequently, the backward operation of the lever 30 in the Y direction causes the moving plate 40 to be returned to the original position outside of the hood part 21*a*. Thus, when the female housing 71 is detached from the male housing 21, it is possible to return the moving plate 40 to the original position outside of the hood part 21*a* easily and reliably since the ribs 36 of the lever 30 pull up the bosses 44 of the moving plate 40 in a drawing manner.

Further, according to the embodiment, each of the ribs 36 of the lever 30 is L-shaped so as to surround a part of corresponding boss 44 of the moving plate 40. This makes it possible to easily and reliably prevent the bosses 44 from being detached from the ribs 36 when pulling the moving plate 40 back to the original position.

As illustrated in FIGS. 4A and 4B, since the male housing 21 is provided with the sub-housing accommodating chamber 22 that houses the male sub-housing 50 accommodating the male terminals 55 and furthermore, the partition wall 23 partitioning the hood part 21*a* and the sub-housing accommodating chamber 22 of the male housing 21 is formed with the tab insertion holes 24 for allowing an insertion of the tab parts 55*a* of the male terminals 55, the deformation of the tab part(s) 55*a* of the male terminal(s) 55 can be easily and reliably detected in advance of fitting the male sub-housing 50 accommodating the male terminal(s) 55 having the so-deformed tab part(s) 55*a* into the sub-housing accommodating chamber 22, whereby it is possible to eliminate the occurrence of a defective fitting product of the male housing 21 and the female housing 71. Consequently, in the process of manufacturing a wire harness composed of a plurality of electric wires 56 connected with the male terminals 55 having the tab parts 55*a* with the lever type connector 10, it becomes possible to eliminate the occurrence of a defective product having deformed tabs as much as possible.

In addition, since each of the tab insertion holes 24 of the partition wall 23 is formed in the same position as the position of corresponding positioning hole 43 formed in the moving plate 40 and also formed with the same hole diameter as that of each of the positioning holes 43, it is possible to manufacture the tab-deformation detecting mechanism simply and at low cost.

Second Embodiment

A lever type connector 10' according to a second embodiment will be described with reference to FIGS. 18 to 21B.

As illustrated in FIGS. 18 to 21B, in the lever type connector 10' according to the second embodiment, an elastic locking piece 29 having a locking protrusion 29*a* and a releasing protrusion 29*b* is integrally formed so as to project from the upside center of the flange part 27 of the male housing 21 of the male connector 20. The locking protrusion 29*a* of the elastic locking piece 29 is adapted so as to be lockable to and detachable from the locking hole 38 formed in the protruding piece 37 of the lever 30. That is, by pushing the releasing protrusion 29*b* of the elastic locking piece 29 downward, the locking state between the locking protrusion 29*a* and the locking hole 38 can be released. Besides, as the other configurations are the same as those of the first embodiment, the same components are indicated with the same reference numerals respectively, and their detailed descriptions are omitted.

In the lever type connector 10' according to the second embodiment, on the premise that the elastic locking piece 29 having the locking protrusion 29*a* and the releasing protrusion 29*b* is formed integrally with the male housing 21 and that the locking hole 38 for locking the locking protrusion 29*a* is formed in the protruding piece 37 of the lever 30, the lever type connector 10' is constructed so that the downward pushing of the releasing protrusion 29*b* of the elastic locking piece 29 allows the locking state between the locking protrusion 29*a* and the locking hole 38 to be released. Thus, when releasing the male housing 21 locked to the lever 30, it is performed to press the releasing protrusion 29*b* of the elastic locking piece 29, whereby the locking state between the locking protrusion 29*a* and the locking hole 38 is released. Therefore, releasing operation of locking between the male housing 21 and the lever 30 is easily achieved. As a result, when replacing the lever 30 or the moving plate 40, the assembling operation of the lever 30 or the moving plate 40 can be accomplished more easily and in a short time.

Meanwhile, although each of the ribs 36 of the lever 30 is L-shaped so as to surround a part of corresponding boss 44 of the moving plate 40 in common with the above-mentioned embodiments, the profile of each of the ribs 36 is not limited to an L-shape and therefore, it may be formed in a curved shape. In the second embodiment, additionally, although the elastic locking piece 29 having the locking protrusion 29*a* and the releasing protrusion 29*b* is formed integrally with the male housing 21, and the locking hole 38 for locking the locking protrusion 29*a* is formed in the lever 30, the elastic locking piece 29 having the locking protrusion 29*a* and the releasing protrusion 29*b* may be formed in the lever 30 on condition of forming the locking hole 38 for locking the locking protrusion 29*a* in the male housing 21 in a modification.

What is claimed is:

1. A lever type connector, comprising:

a male housing having a hood part;

a lever rotatably supported on the male housing via pivot shafts;

a moving plate for positioning a tab part of a male terminal within the hood part;

a female housing configured to be fitted into and detached from the hood part;

a cam groove formed in the lever;

a cam follower formed in the female housing;

a rib provided in the lever; and a boss formed in the moving plate, the lever type connector configured so that the female housing is moved to an inner side of the hood part together with the moving plate by forward-operating the lever in a direction capable to fit the male housing and the female housing under a condition that the cam follower is engaged with the cam groove, whereby the female housing is to be fitted into the male housing, wherein the rib abuts against the boss when the male housing is not fitted to the female housing under the condition that the cam follower is engaged with the cam groove; and abutting between the rib and the boss is released by forward-operating the lever in the direction capable to fit the male housing and the female housing, whereby the female housing is permitted to push the moving plate into the hood part.

2. The lever type connector of claim 1, wherein when the female housing is to be detached from the male housing, the rib abuts against the boss by backward-operating the lever in a direction capable to detach the male housing from the female housing then the moving plate is returned to an original position outside the hood part.

3. The lever type connector of claim 1, wherein the rib is formed in a curved shape so as to enable a part of the boss to be surrounded.

4. The lever type connector of claim 1, wherein either one of the male housing and the lever is formed with an elastic locking piece provided with an locking protrusion and a releasing protrusion; and the other of the male housing and the lever is formed with an locking hole which enables to lock the locking protrusion.

* * * * *